United States Patent [19]

Docker et al.

[11] Patent Number: 4,886,249

[45] Date of Patent: Dec. 12, 1989

[54] SPRING BANDS FOR INCORPORATION IN SPRING UNITS

[75] Inventors: Leslie T. Docker, Nr. Kenilworth; William Whittleworth, Stockport, both of United Kingdom

[73] Assignee: Multilastic Limited, Carthage, Mo.

[21] Appl. No.: 278,532

[22] PCT Filed: Jun. 3, 1987

[86] PCT No.: PCT/GB87/00379

§ 371 Date: Nov. 23, 1988

§ 102(e) Date: Nov. 23, 1988

[87] PCT Pub. No.: WO87/07539

PCT Pub. Date: Dec. 17, 1987

[51] Int. Cl.[4] ..... F16F 3/04; B21F 27/16

[52] U.S. Cl. ..... 267/91; 140/3 CA; 140/89

[58] Field of Search ..... 140/3 CA, 89; 267/91, 267/97; 5/254, 255, 256, 257

[56] References Cited

U.S. PATENT DOCUMENTS 4,112,726 9/1978 Adams et al. ..... 140/3 CA
4,771,494 9/1988 Zapletal et al. ..... 267/91

FOREIGN PATENT DOCUMENTS 1155218 4/1964 Fed. Rep. of Germany .
2030793 11/1971 Fed. Rep. of Germany .
937644 9/1963 United Kingdom .
1095980 12/1967 United Kingdom .
1104884 3/1968 United Kingdom .
1183315 6/1970 United Kingdom .
2143731A 2/1985 United Kingdom .

*Primary Examiner*—Lowell A. Larson
*Attorney, Agent, or Firm*—Wood, Herron & Evans

[57] ABSTRACT

A known kind of spring unit, for use in mattresses, seats and the like, is made as an assembly of spring bands which are disposed side by side and a plurality of helical wires (5,6) which extend transversely to the bands and are linked to them. Each spring band comprises a row of springs (1), and each pair of adjacent springs is integrally connected by a connector (2) which includes two spaced end portions (3), which are transverse to the band and are embraced by helical wires. Variations in manufacture lead to variations in the spacing between the end portions. The invention provides for the further bending of each connector (2), after initial formation of the spring band, to cause the end portions to take up a predetermined spacing. This is effected by reshaping corner portions of the connector between dies (31,42) so that the corner portions (8) are finally of more gentle curvature than they were (12) when initially formed.

10 Claims, 6 Drawing Sheets

SPRING BANDS FOR INCORPORATION IN SPRING UNITS

This invention relates to spring bands for incorporation in spring units. Spring units can be incorporated in mattresses, seats, cushions and other products.

The invention is particularly concerned with spring units comprising an assembly of spring bands and helical wires. Each of the spring bands is of a known kind (hereinafter referred to as a spring band of the kind specified) comprising a length of wire bent so as to form a plurality of coil springs disposed side by side in a row, ends of the coil springs lying in or near opposed edge faces of the band, and a plurality of connectors integral with the springs, each such connector lying in or near an edge face of the band and serving to interconnect two adjacent springs in the row, and each connector having two spaced end portions, which extend transversely of the band, with an intermediate portion, between said end portions, which extends past said two adjacent springs.

Spring bands of the kind specified can be assembled together to form a spring unit of a known kind (hereinafter referred to as a spring unit of the kind specified) comprising a plurality of spring bands, each of the kind specified, disposed side by side so that their edge faces lie in or near main faces of the unit, and a plurality of helical wires, some lying in or near one of said main faces and others lying in or near the other of said main faces and each helical wire embracing component portions of each band, namely two adjacent end portions of two neighbouring connectors.

In the manufacture of spring units of the kind specified it is the usual practice first to make long lengths of spring bands, and to wind up each band to form a roll as successive springs are formed. A plurality of such rolls are then taken to an assembly machine where they are progressively unwound and fed to a linking station where helical wires are attached to them. When a sufficient number of helical wires has been attached to the spring bands to form a spring unit of a desired length, the unit is detached. A machine suitable for assembling bands of springs is described and illustrated in the complete specification of British patent No. 1 095 980, granted to Multilastic Limited, and the detachment of individual spring units is described and illustrated in the complete specifications of British patents Nos. 1 104 884 and 1 183 315, also granted to Multilastic Limited.

The method of assembly outlined above therefore requires the preliminary manufacture of long lengths of spring bands. This is normally carried out by means of machines of the kind described and illustrated in the complete specification of British patent No. 937 644, granted to Willi Gerstorfer. Slight variations in the hardness or other physical properties of the wire may well result in slight variations in the dimensions of the resultant spring bands from a single machine. Moreover it has often been the practice to employ several machines for the production of spring bands and to use, at random, spring bands produced by different machines. Slight variations in the settings of the machines are also likely to result in slight variations in the dimensions of the resultant spring bands. Most of these variations are largely unimportant in view of the resilience of the bands and of the spring units assembled from them. However, it is found that variations in the spacing between end portions of the connectors may lead to problems.

The aim of the present invention is to enable those problems to be overcome or at least reduced.

From one aspect the present invention consists in a method of making a spring band for incorporation in a spring unit, the method comprising subjecting a length of wire to an initial bending operation in which it is shaped to form both a plurality of coil springs disposed side-by-side in a row, ends of the coil springs lying in or near opposed edge faces of the band, and a plurality of connectors integral with the springs, each connector lying in or near an edge face of the band and serving to interconnect two adjacent springs in the row, each connector having two spaced end portions, which extend transversely of the band, and an intermediate portion, between said end portions, which extends past said two adjacent springs, the method being characterised in that subsequent to said initial bending of the length of wire, at least part of each connector is subjected to a further bending operation such as to cause the end portions to take up positions in which they are spaced apart at a predetermined spacing.

A preferred method is characterised in that, when each connector is subjected to said further bending operation, each of two corner portions thereof, which extend between the intermediate portion and the end portions, is bent from an initial arcuate shape to a final arcuate shape which is of more gentle curvature than that of the initial arcuate shape. The further bending operation applied to each connector is preferably effected by shaping the corner portions between complementary dies.

As the relative angular positions between the intermediate portion and the end portions of each connector normally remain substantially unaltered during the further bending operation it is necessary to incorporate more wire into each of the corner portions during that operation. This extra wire will normally be taken in part from the intermediate portion and in part from the adjacent end portion, but the ratio between those parts depends, of course, on the spacing between the corner portions resulting from the initial formation of the connector. For example, if the connector, as produced during the initial bending operation, has corner portions that are slightly too close together, reshaping of the corner portions will result in slightly more wire than usual being taken from the end portions in order to bring about the desired adjustment in the spacing between the end portions of the connector. Nevertheless it will be understood that in normal manufacture the lengths of wire concerned are very small, as errors in the spacing between the end portions of a connector are unlikely to exceed a few millimetres.

The method is preferably characterised in that each connector, after it has been formed in said initial bending operation, but at least before said further bending operation has been completed, is subjected to an intermediate bending operation in which a central part of the intermediate portion thereof is bent to form a supporting structure which extends at least part way across the associated edge face of the band of springs.

The supporting structure may be of the kind described in the specification of British patent No. 2 143 731 of Multilastic Limited.

In spring units of the kind specified it has hitherto been usual for the end portions of the connectors to be straight or substantially straight so that when the spring bands are incorporated in a spring unit of the kind specified, the end portions of the connectors are loose within the helical wires that embrace them. While this arrangement is satisfactory from some points of view, it nevertheless leads to certain problems. One problem is that when a spring unit of that existing kind is in use there are likely to be relative movements, between the end portions of the connectors and the helical wires that embrace them, that give rise to unwanted metallic noises.

With a view to overcoming or at least reducing that problem it is preferred to make the end portions of the connectors, that in use are embraced by the helical wires, of non-rectilinear shape, the arrangement being such that in use they are not loose within the helical wires and there is thus no freedom for relative movement between said end portions and said helical wires in a direction transverse to the axes of the helical wires, that is a direction lengthwise of the band of springs.

In a preferred form of spring band the end portions of the connectors are of bowed or arcuate shape.

The end portions of the connectors are preferably so shaped that they are resiliently deformed when embraced by the helical wires so that there is frictional engagement between the end portions and the helical wires.

Preferably the arrangement is also such that the said end portions of the connectors are so shaped that there is no freedom for relative longitudinal or axial movement between the end portions of the connectors and the helical wires.

In a conventional spring unit of the kind specified, end portions of the connectors have freedom for limited movement within the helical wires so that slight variations in the spacing between the end portions can be accommodated. In a spring unit incorporating spring bands of the preferred kind referred to above and in which the end portions of the connectors are not free to move, relative to the helical wires, in a direction lengthwise of the band of springs, the overall length of any one band of springs within a spring unit is predetermined by the initial dimensions of the band. Moreover if the spacing between end portions of successive connectors in any one band is very slightly larger or smaller than the intended spacing, the error is multiplied by the number of connectors lying end to end in the band. Consequently the error in the overall length of the band may be significant. This can be particularly awkward if, as commonly happens, neighbouring bands of springs are made by different machines and the spacing between end portions of the connectors of one band differs uniformly from the spacing between the corresponding portions of neighbouring bands. Use of the present invention can overcome that problem or reduce it to an acceptable level.

The frictional engagement between the end portions of the connectors and the helical wires is found markedly to reduce any tendency for the helical wires to rotate when the spring unit is in use, and thus to reduce the likelihood of the ends of the. helical wires protruding and causing damage or injury. Nevertheless it is preferred, as an extra safeguard, to continue to form closed eyes or loops at the ends of the helical wires, as has been conventional in this art.

Another consequence of the use of connectors with end portions that are not loose within the helical wires is that the spring unit tends to be overall less floppy than a spring unit of the previous kind, in which the end portions of the springs were loose within the helical wires. The increased rigidity makes it easier to handle the spring units and may also make it easier to store the spring units.

From another aspect the present invention consists in a spring band, for incorporation in a spring unit, when made by a method in accordance with that aspect of the present invention set forth above.

From another aspect the present invention consists in a device for use in the manufacture of a spring band for incorporation in a spring unit, the spring band being a known kind comprising a length of wire that is shaped to form both a plurality of coil springs disposed side-by-side in a row, ends of the coil springs lying in or near opposed edge faces of the band, and a plurality of connectors integral with the springs, each connector lying in or near an edge face of the band and serving to interconnect two adjacent springs in the row, each connector having two spaced end portions, which extend transversely of the band, and an intermediate portion, between said end portions, which extends past said two adjacent springs, the device being characterised in that it comprises complementary dies operative to perform a further bending operation on each connector, after it has been formed in an initial bending operation, whereby the end portions of the connector are caused to take up positions in which they are spaced apart at a predetermined spacing.

The device is preferably further characterised in that the complementary dies comprise a pair of concave dies, in fixed relationship to each other and a pair of convex dies in fixed relationship to each other, the concave dies and convex dies being movable relatively to each other from an open position to a closed position, in the course of which movement they are in use operative to bend each of two corner portions of a connector, which corner portions extend between the intermediate portion and the end portions of the connector, from an initial arcuate shape to a final arcuate shape which is of more gentle curvature than that of the initial arcuate shape.

The device is preferably mounted adjacent to a guide path for a spring band and has shift means operative to withdraw the dies from the guide path when they are not in use so as to allow the spring band to move along the guide path. Preferably there is also feed means operative to feed a spring band intermittently along the guide path.

In a preferred arrangement there are two similar devices, the devices being mounted on opposite sides of the guide path along which a spring band can be passed, the arrangement being such that in use, one device can perform a further bending operation on the connectors at one edge face of the spring band and the other device can perform a further bending operation on the connectors at the other edge face of the band. The arrangement is preferably such that the devices can operate simultaneously. To this end the devices are preferably positioned so that each device can operate on an adjacent connector while the spring band remains in one operative position, it then being possible to shift the band along the guide path into another operative position in which the devices can operate on other connectors.

The device or each device may also include supplementary dies operative to bend an intermediate portion of a connector to provide a supporting structure of the kind described in the specification of the aforementioned British patent No. 2 143 731 of Multilastic Limited. The supplementary dies are preferably disposed between the dies that reshape the corner portions of connectors, the arrangement being that in use, in a first step the supplementary dies operate on the intermediate portion of a connector to form a supporting structure and then, in a second step, the pairs of dies operate to reshape the corner portions at the ends of the same intermediate portion.

The device or each device also preferably includes retractable stop means movable to an active position in which it is operable to locate a connector relative to the dies of the device before the dies are operated to shape or reshape the connector, and movable to an inactive position in which it can permit the spring band to move along the pathway.

When feed means is provided it preferably comprises at least one reciprocable pusher operable, on an active stroke, from a base position, to engage the spring band and to move it forward, and on a return stroke to disengage itself automatically from the spring band and to return to its base position.

In the accompanying drawings

Figure 1:
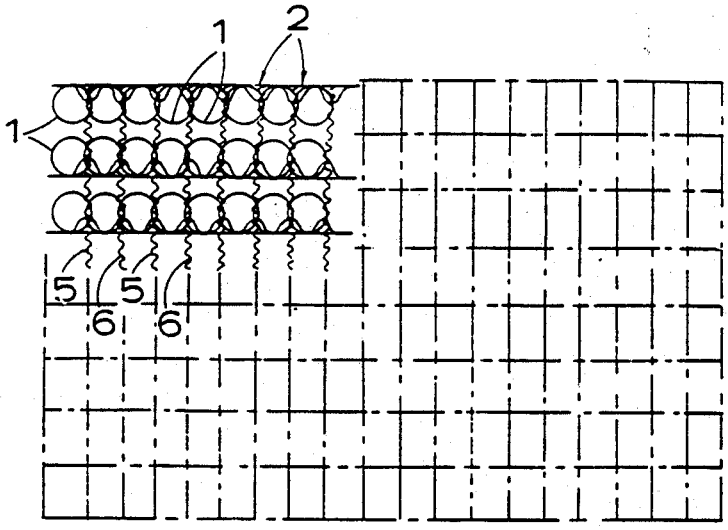
FIG. 1 is a diagrammatic plan view of part of a spring unit incorporating spring bands.
Figure 2:
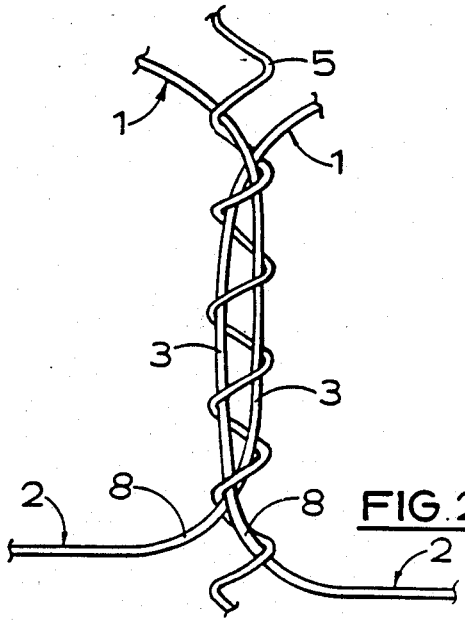
FIG. 2 is a view to a larger scale of a portion of the unit shown in FIG. 1.

The spring unit, of which part is shown in FIG. 1, and of which a detail is shown in FIG. 2, is a spring unit of the kind specified, and it is formed as an assembly of spring bands and helical wires. Each of the spring bands incorporated in the unit is of the kind shown in FIG. 3, and is a spring band of the kind specified. The spring band in FIG. 3 comprises a length of wire bent so as to form a plurality of coil springs 1 disposed side by side in a row, ends of the coil springs lying near opposed edge faces of the band. In this particular form of spring band alternate springs are coils of one hand while the remaining coils are of the other hand. In this way each left-handed coil is disposed between two right-handed coils, and each right-handed coil is disposed between two left-handed coils. This arrangement, however, is not an essential feature of the invention. The length of wire also affords a plurality of connectors 2 that are integral with the springs 1. Each connector 2 lies in or near an edge face of the band and serves to interconnect two adjacent springs in the row. Each connector 2 has two spaced end portions 3 with an intermediate portion 4 between them. Each of the two end portions 3 extends transversely of the band. The intermediate portion 4 of each connector extends past the two springs that are interconnected by the connector of which it forms a part.

After the springs 1 have been formed, a turn of each spring is passed round a turn of the next adjacent spring so that each spring becomes linked to its neighbouring two springs. This is made possible by the fact that the two springs of each adjacent pair of springs have coils of opposite hands. This interlinking of the springs is already known in spring bands of this kind.

Figure 3:
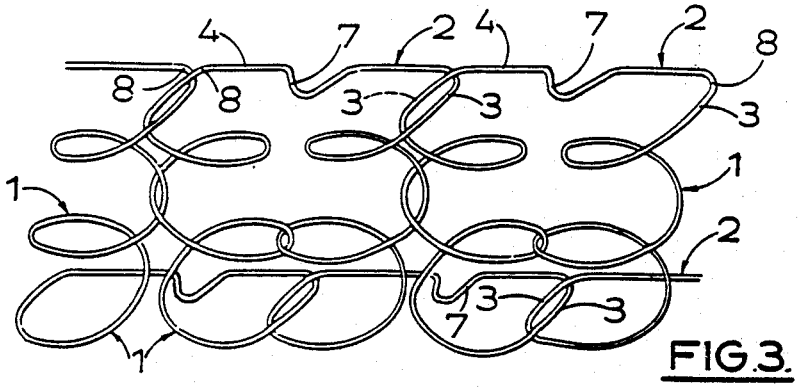
FIG. 3 is a perspective view of part of a spring band of the kind incorporated in the spring unit illustrated in FIG. 1.

In the manufacture of a spring unit of the kind illustrated in FIG. 1, spring bands of the kind illustrated in FIG. 3 are disposed side by side so that their edge faces lie in or near the main faces of the unit. They are interconnected by a plurality of helical wires 5 and 6, the helical wires 5 lying in one or near one of the main faces and the helical wires 6 lying in or near the other of the main faces. Each helical wire embraces component portions of each of the spring bands, namely two adjacent end portions 3 of two neighbouring connectors 2.

Those features of the spring bands and spring unit thus far described are already known, and there now follows a description of the features thereof that have not previously been known.

Hitherto it has been usual for the end portions of the connectors to be substantially rectilinear so that they are loose within the helical wires that embrace them. It will be seen from FIG. 2, however, that the end portions 2 of the connectors are of bowed or arcuate shape, the arrangement being such that parts of each end portion 2 abut one side of the helical wire that embraces it, while a central part of each end portion 2 abuts the opposite side of the helical wire. In consequence the end portions 2 are not loose within the helical wires and there is no freedom for relative movement, between the end portions 2 and the helical wires 5 and 6, in a direction transverse to the axes of the helical wires. Moreover, the end portions 2 are resiliently deformed when embraced by the helical wires so that they bear against the helical wire and there is frictional engagement between the end portions and the helical wires. Further, the end portions 2 are so shaped and are of a length such that at the positions where the connectors emerge from the helical wires, the connectors abut the helical wires so that there is no freedom for relative longitudinal or axial movement between the end portions of the connectors and the helical wires. Advantages of this arrangement are described above.

Figure 5:
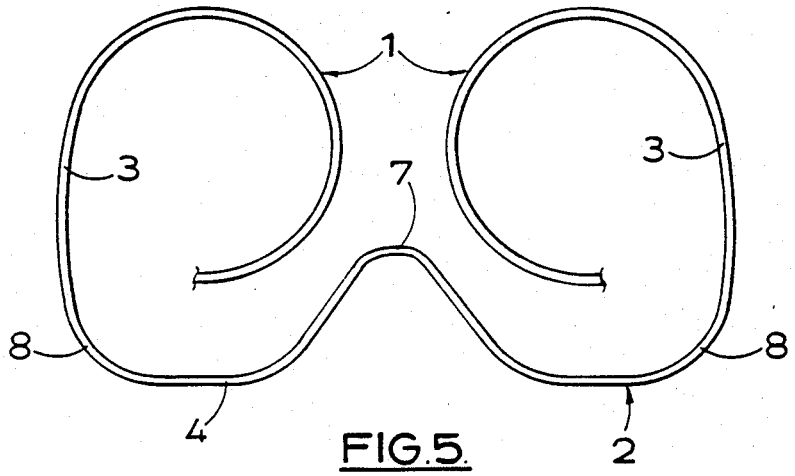
FIG. 5 shows, in a completed state, a connector formed from the partially formed connector of FIG. 4.

The intermediate portion 4 of each connector 2 could be of rectilinear shape but in fact a central portion thereof is shaped, as illustrated in FIG. 5, to form a supporting structure 7. The function of such a supporting structure forms no part of the present invention and is described in the specification of the aforementioned British patent No. 2 143 731. It will therefore not be further described herein.

Each end of the intermediate portion 4 is connected to the adjacent end portion 3 by an arcuate corner portion 8.

Figure 4:
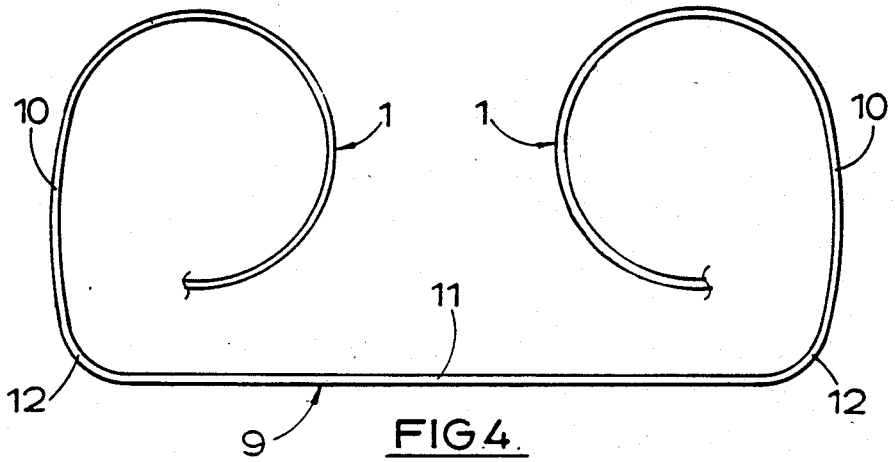
FIG. 4 shows, in a partially formed state, a connector constituting part of a spring band.

In the manufacture of spring bands of the kind illustrated in FIG. 3, use is made of a spring-making machine of the kind described and illustrated in the complete specification of the aforementioned British patent No. 937 644. This is used to subject a length of wire to an initial bending operation in which it is shaped to form springs 1 interconnected by partially formed connectors 9. As illustrated in FIG. 4, each partially formed connector 9 has end portions 10, similar in shape to the end portions 3 of the finished connectors 2. The intermediate portion 11 of each partially formed connector 9 is, however, rectilinear, as illustrated. Moreover, each end of the intermediate portion 11 is connected to the adjacent end portion 10 by an arcuate corner portion 12 of relatively sharp curvature.

The partially formed spring band issuing from the spring-making machines passes onto a support made of flexible sheet material and then passes from the support onto a table where the coils are successively linked together. This may be effected manually but is preferably effected mechanically as described in that aforementioned complete specification. The linked coils then pass into a guide path in the form of a channel (not shown) with a flat base and vertical side walls. In the channel, the coils are disposed with their axes in a common horizontal plane and the partially formed connectors 9 lying in parallel vertical planes against the side walls of the channel. The intermediate portions of the connectors lie in the bottom corners of the channel, where the side walls meet the base thereof.

Figure 6:
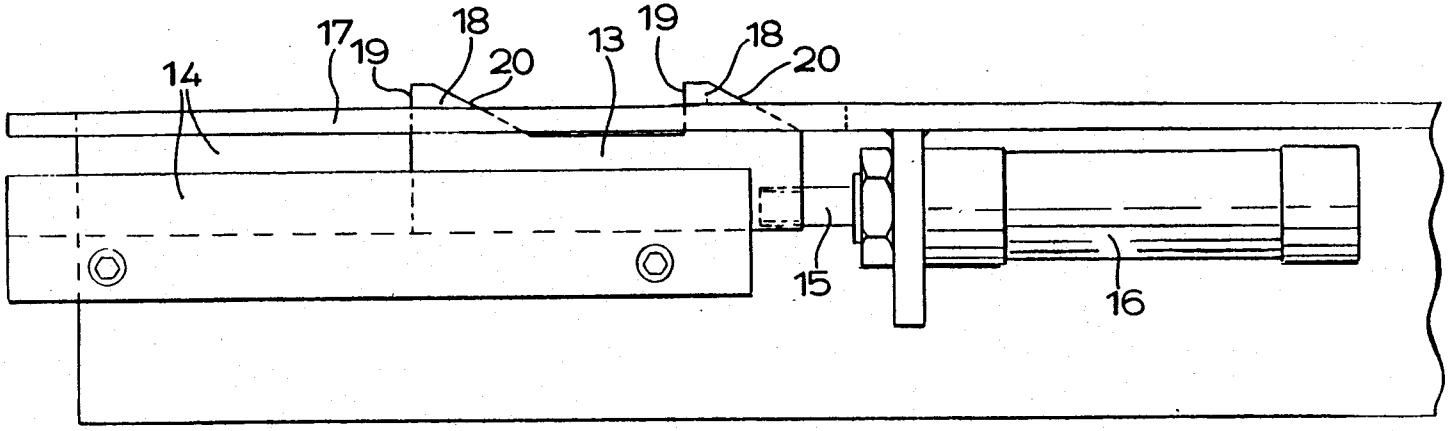
FIG. 6 is a plan view of feed mechanism for use in association with a device shown in FIGS. 6 to 8.

The partially formed spring band is moved forward intermittently along the channel by feed means comprising two feed devices, each similar to that illustrated in FIG. 6. One such feed device is mounted in each of the side walls of the channel. Instead of being disposed directly opposite each other, one device is spaced further along the channel than the other by a distance substantially equal to half the length of a partially formed connector 9. Each feed device comprises a horizontal bar 13 mounted for longitudinal reciprocation in a direction lengthwise of the channel. The bar runs in a groove defined by fixed components 14 which prevent other movement of the bar. One end of the bar is connected to the piston rod 15 of a pneumatic piston-and-cylinder unit 16 fixed to the outer side of a vertical plate 17 constituting one of the side walls of the channel. Two teeth 18 project from the bar into the channel through a horizontal slot in the plate 17. Each of the teeth has a leading face 19 lying in a vertical plane normal to the direction of reciprocation, and a trailing face 20 in a vertical plane inclined to that direction. The space between the leading faces 19 of the teeth is also substantially equal to half the length of a partially formed connector 9. The units 16 operate in unison and their operation is synchronised with that of the spring-making machine. During a first forward stroke of each feed device from the base position illustrated, the leading face 19 of the rear tooth, that is the tooth nearer the inlet end of the channel, engages the trailing end portions 10 of a partially formed connector 9 adjacent to it and pushes the connector, and thus the band, forwards through a distance a little greater than half the length of a partially formed connector. During the following rearward stroke, the trailing face 20 of the front tooth passes the end portion previously engaged by the rear tooth, temporarily displacing the resilient end portion towards the middle of the channel. At the end of the rearward stroke the end portion lies just ahead of the front tooth so that during a second forward stroke the front tooth pushes forward the partially formed connector and with it the spring band. Finally, during second rearward stroke the rear tooth passes the next end portion ready to push it forward. This cycle of two strokes is repeated indefinitely.

Figure 7:
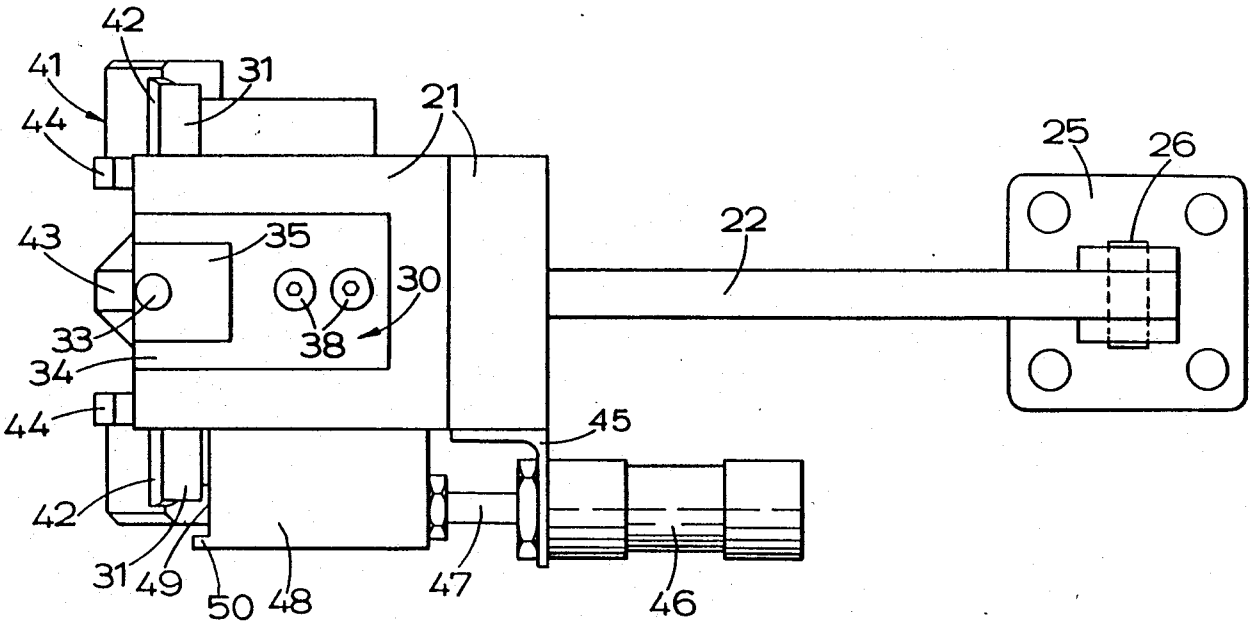
FIG. 7 is a plan view of a device in accordance with the present invention.
Figure 8:
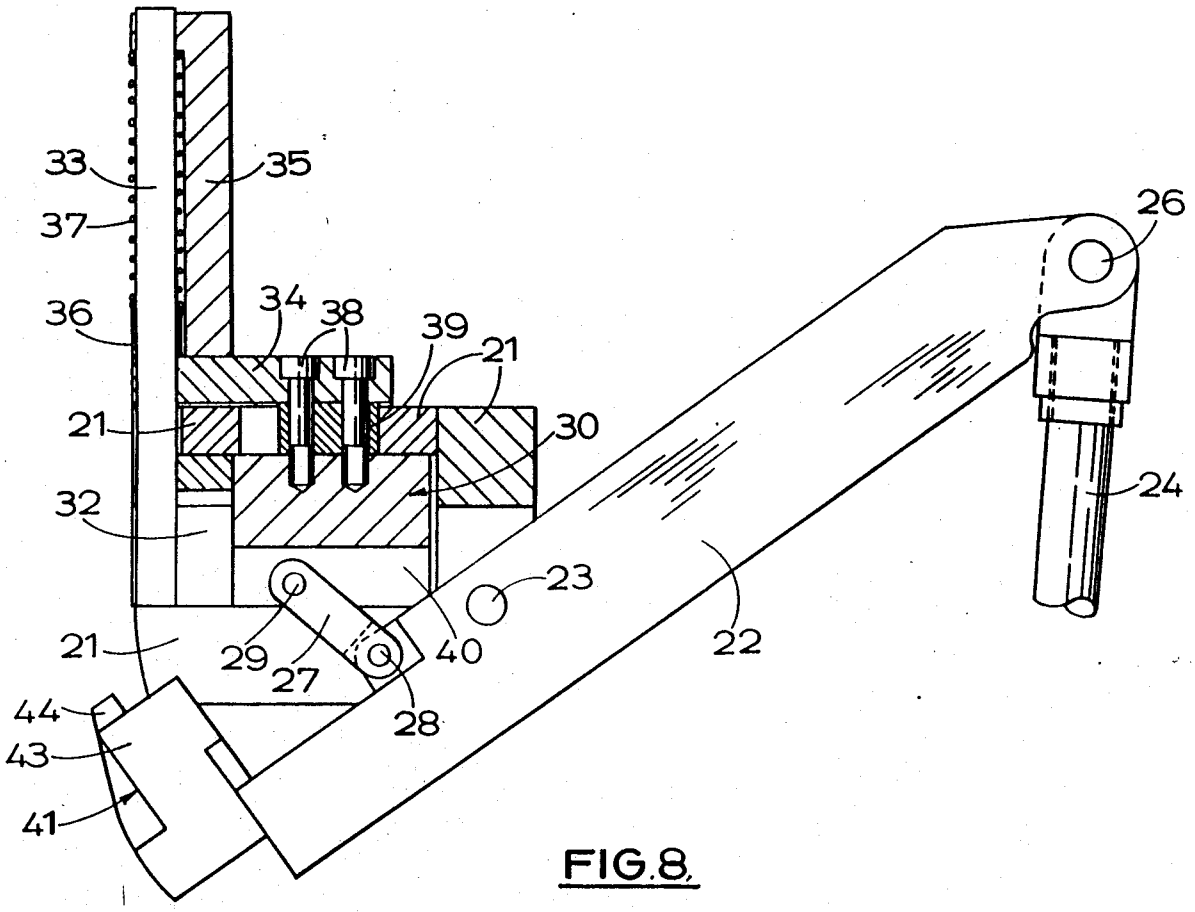
FIG. 8 is a side view of the device shown in FIG. 7, with parts sectioned to reveal some of the interior thereof.
Figure 9:
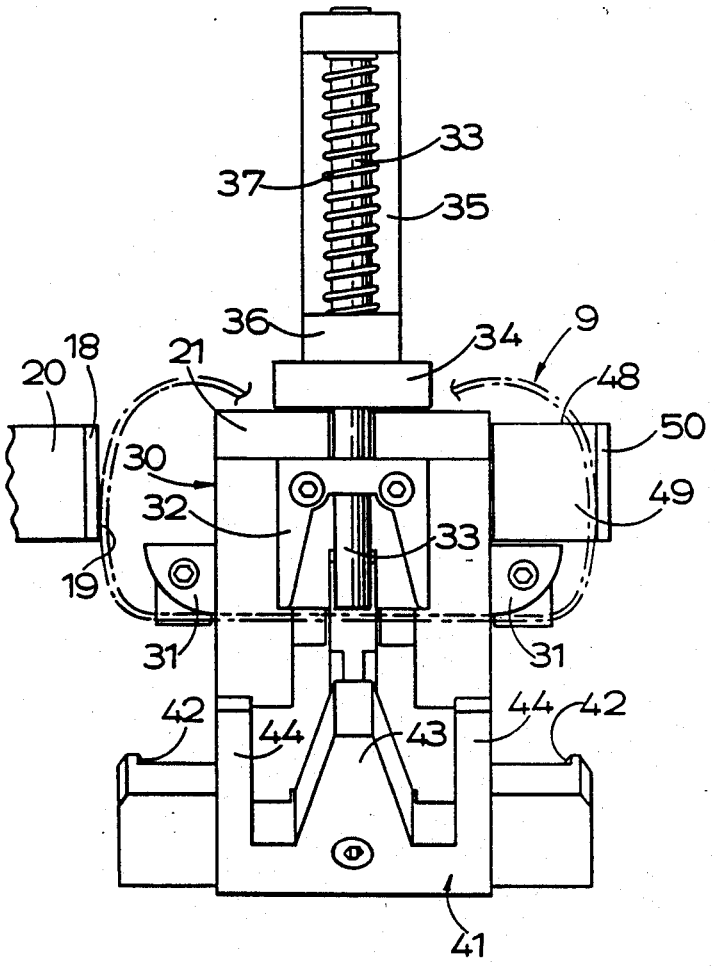
FIG. 9 is a front view of the device shown in FIGS. 7 and 8.

At the end of the second forward stroke of the feed device on each side of the channel, a partially formed connector is in a position immediately adjacent to a device of the kind shown in FIGS. 7 to 9. One such device is mounted outside each of the side walls of the channel, while the base of the channel in front of each device is cut away to allow parts of the device to rise through the base as described below.

The device illustrated comprises fixed components 21 to which a bar 22 is pivotally mounted by means of a horizontal pivot pin 23 parallel with the walls of the channel. The bar can be pivoted between an initial position, as illustrated, in which it is inclined to the horizontal and a final position, in which it is horizontal, by means of a pneumatic piston-and-cylinder unit 25. The upper end of the piston rod 29 of the unit 25 is pivoted at 26 to one end of the bar 22. One end of a link 27 is pivoted at 28 to the bar 22, and the other end of the link 27 is pivoted at 29 to a carriage 30 slidably mounted on the fixed components 21. When the bar is moved from its initial position to its final position, the carriage moves from a retracted position, as illustrated, in which it is flush with the adjacent side wall of the channel, to a working position, in which a forward part thereof projects into the channel.

The forward part of the carriage 30 includes two arcuate quadrant-shaped dies 31 presenting convex surfaces corresponding in shape to the corner portions 8 of a completed or fully-formed connector 2. Between the dies 31, the forward part of the carriage includes a die 32, substantially in the shape of an inverted letter V, corresponding in shape to the supporting structure 7. A cylindrical rod 33 is also mounted on the forward part of the carriage 30 and can slide vertically in axially aligned holes formed in an upper part of the dies 32, in a plate 34 constituting part of the carriage, and in an upper limb of a bracket 35 mounted on the plate 34. The rod 33 carries a block 36 which can abut the plate 34 to limit its downward movement. A helical compression spring 37 around the rod acts between the block 36 and said upper limb of the bracket 35 to urge the rod downwards. Bolts 38 extend through the plate 34 and a small block 39 into the main body 40 of the carriage 30, the block 39 running in a slot in one of the fixed components 21.

At its forward end the bar 22 carries a die block assembly 41 formed with two, horizontally spaced, arcuate dies 42 of concave form complementary to that of the dies 31. The die block assembly 41 is also formed centrally with an upwardly projecting die 43 of a shape complementary to that of the die 32. A pair of arms 44 project upwards, one on either side of the die 43, the arms being less thick than the die.

One of the fixed components 21 carries an angled bracket 45 to which is secured the cylinder of a pneumatic piston-and-cylinder unit 46. The piston rod 47 of the unit 46 projects horizontally towards the channel and carries at its forward end a block 48 with a flat face 49 having projecting from it a vertical stop 50 constituting retractable stop means.

In use, when the feed device adjacent to the setting device illustrated performs its second stroke, the piston-and-cylinder unit 46 is operated so as to cause the stop 50 to move to an active position in which it projects into the channel. At the end of that second stroke a partially formed connector, similar to that shown in FIG. 4 and having the reference numeral 9, is disposed immediately adjacent to the device illustrated. The forward end portion 10 of the connector abuts the stop 50 while the rear connector abuts the leading face 19 of the more forward of the teeth 18. The partially formed connector is thus located against movement to or fro along the channel.

Before the bar 13 of the feed device is withdrawn, the piston-and-cylinder unit 25 is operated to move the bar 22 from its initial position (illustrated) to its final position. As this occurs the carriage 30 moves from its retracted position to its working position. During early stages in the movement of the bar 22 the top of the upwardly projecting die 43 engages a central part of the intermediate portion 11 of the partially formed connector 9 and presses it against the lower end of the rod 33. Further movement of the bar 22 causes the die 43 to force the wire upwards into the die 32, while the fact that the central part thereof is trapped between the die 43 and the rod 33 prevents any tendency there might otherwise be for the wire to move endwise relative to the dies. Moreover, the arms 44 prevent the intermediate portion of the connector escaping by moving in a direction towards the middle of the channel.

During this part of the movement the end portions 10 of the partially formed connector are drawn towards each other and away from the stop 50 and the more forward one of the teeth 18. The stop 50 and the more forward tooth thus cease to locate the connector. The piston-and-cylinder units 16 and 46 can then be operated to withdraw the stops that were initially locating the partially formed connector.

During the final stages of movement of the bar 22 to its final position the dies 43 and 32 together complete the shaping of the supporting structure 7. As this occurs, the arcuate dies 31 and 42 finally co-operate to subject the connector to a further bending operation in which the end portions 10 are rebent or reshaped so that their relatively sharp, initial curves are opened out to form final arcuate corner portions 8 of more gentle curvature. As explained above, this action serves to set accurately the distance between the end portions 3 of the finished connector.

After the final shaping of the connector has been completed, the piston-and-cylinder unit 16 operates again to return the bar to its initial position. The piston-and-cylinder unit 25 is also operated to cause the die block assembly 41, with the arms 44, to return to a position below the level of the bottom of the channel and cause the carriage to return to its retracted position. The spring band is thus free to be moved forward again by the feed devices.

It is to be understood that there is a feed device and an associated rebending device on one side of the channel, and a similar feed device and a similar, associated rebending device on the other side of the channel. The devices on one side of the channel are offset lengthwise relative to the devices on the other side of the channel by a distance substantially equal to half the length of a partially formed connector 9. The two feed devices operate in unison to feed the spring bands forward step by step, the band moving a distance equal to half the length of a partially formed connector at each step. After alternate steps the rebending devices are operated in unison, as described above, to convert two partially formed connectors 9, one on each side of the channel, into fully formed connectors 2.

The completed spring band, as it progressively emerges from the channel, is wound up to form a roll, in a known manner, about an axis parallel with the axes of the coil springs. A plurality of rolls of spring band, each made in the manner described above, are assembled together with helical wires to form spring units of the kind specified. This can be effected with the aid of a machine of the kind described and illustrated in the complete specification of the aforementioned British patent No. 1 095 980. If desired the machine may be modified by the incorporation in it of locating means or jaws for the helical wires, of the kind described and illustrated in the complete specification of British patent No. 1 522 611 granted to Multilastic Limited. In either case, operation of the machine is such that when end portions 3 of the connectors are gripped in the locating means or jaws they are resiliently deformed from the curved shape shown in FIG. 5 so as to approach the rectilinear more closely. This enables the helical wires to be assembled with the end portions of the connectors without difficulty. When the end portions of the connectors are subsequently released, however, the end portions attempt to return to their original shapes, as illustrated in FIG. 5, but they are prevented from doing this by the presence of the helical wires which embrace them. The end portions thus remain resiliently deformed or stressed and bear against the helical wires. This results in there being frictional engagement between the helical wires and the end portions of the connectors, with the advantages outlined above.

It is to be understood that it is not essential for the devices for effecting the further bending operation to be situated adjacent to the spring-making machine. If desired it may be situated elsewhere and may be used independently of the spring-making machine. For example, spring bands formed by the spring-making machine may be formed into rolls, the rolls may be subsequently unwound and the spring bands may then be subjected to a further bending operation by the devices, before being rolled up again or being fed directly to an assembly machine.

It will also be appreciated that it is not essential for supporting structures 7 to be formed immediately before said further bending operation. Indeed, it is not essential for there to be supporting structures at all. When there are to be no supporting structures, the die 32 and the complementary die 43 are omitted. The cylindrical rod 33 may also be omitted, but in that case it is preferred to provide some other resilient gripping means operative to grip a central part of the intermediate portion 11 of the partially formed connector before the quadrant-shaped dies 31 and 42 co-operate to reshape the corner portions of the connector.

As indicated above, it would be possible to shape a connector so as to form a supporting structure, such as the supporting structure 7, in an operation separate from that in which said further bending operation is effected. Nevertheless, in that case it would then be highly desirable, if not essential, to form the supporting structure before carrying out said further bending operation rather than after carrying it out. It is in fact always preferable to carry out said further bending operation as the last forming operation on the connector.

We claim:

1. A method of making a spring band for incorporation in a spring unit, the method comprising subjecting a length of wire to an initial bending operation in which it is shaped to form both a plurality of coil springs (1) disposed side-by-side in a row, ends of the coil springs lying in or near opposed edge faces of the band, and a plurality of connectors (2) integral with the springs, each connector lying in or near an edge face of the band and serving to interconnect two adjacent springs in the row, each connector having two spaced end portions (3), which extend transversely of the band, and an intermediate portion (4), between said end portions, which extends past said two adjacent springs, the method being characterised in that subsequent to said initial bending of the length of wire, at least part of each and every connector is subjected to a further bending operation such as to cause the end portions to take up positions in which they are spaced apart at a predetermined spacing.

2. A method according to claim 1 further characterised in that, when each connector (2) is subjected to said further bending operation, each of two corner portions thereof, which extend between the intermediate portion (4) and the end portions (3), is bent from an initial arcuate shape (12) to a final arcuate shape (8) which is of more gentle curvature than that of the initial arcuate shape.

3. A method according to claim 2 further characterised in that the further bending operation applied to each connector is effected by shaping the corner portion between complementary dies (31,42).

4. A method according to claim 1 further characterised in that each connector, after it has been formed in said initial bending operation, but at least before said further bending operation has been completed, is subjected to an intermediate bending operation in which a central part of the intermediate portion thereof is bent to form a supporting structure (7) which extends at least part way across the associated edge face of the band of springs.

5. A spring band, for incorporation in a spring unit, when made by a method according to any one of the preceding claims and in which the end portions of each and every connector are spaced apart at a predetermined spacing.

6. A spring band according to claim 5 further characterised in that the end portions (3) of the connectors are of non-rectilinear shape, the arrangement being such that in use, when the spring band is incorporated in a spring unit of the kind comprising a plurality of spring bands disposed side by side so that their edge aces lie in or near main faces of the unit, and a plurality of helical wires, some lying in or near one of said main faces and others lying in or near the other of said main faces and each helical wire embracing component portions of each band, namely two adjacent end portions of two neighbouring connectors, there is no freedom for relative movement between said end portions and said helical wires in a direction lengthwise of the band of springs.

7. A device for use in the method of making a spring band according to claim 1 for incorporation in a spring unit, the spring bend being a known kind comprising a length of wire that is shaped to form both a plurality of coil springs (1) disposed side-by-side in a row, ends of the coil springs lying in or near opposed edge faces of the band, and a plurality of connectors (2) integral with the springs, each connector lying in or near an edge face of the band and serving to interconnect two adjacent springs in the row, each connector having two spaced end portions (3), which extend transversely of the band, and an intermediate portion (4), between said end portions, which extends past said two adjacent springs, the device being characterised in that it comprises complementary dies (31,42) operative to perform a further bending operation on each and every connector, after it has been formed in an initial bending operation, whereby the end portions (3) of the connector are caused to take up positions in which they are spaced apart at a predetermined spacing.

8. A device according to claim 7 further characterised in that the complementary dies comprise a pair of concave dies (42), in fixed relationship to each other and a pair of convex dies (31) in fixed relationship to each other, the concave dies and convex dies being movable relatively to each other from an open position to a closed position, in the course of which movement they are in use operative to bend each of two corner portions of a connector, which corner portions extend between the intermediate portion (4) and the end portions (3) of the connector, from an initial arcuate shape (12) to a final arcuate shape (8) which is of more gentle curvature than that of the initial arcuate shape.

9. A device according to either of claims 7 and 8 further characterised in that it is mounted adjacent to a guide path for a spring band and having shift means (25) operative to withdraw the dies from the guide path when they are not in use so as to allow the spring band to move along the guide path.

10. A device according to claim 9 further characterised in that there is feed means (13 to 20) operative to feed a spring band intermittently along the guide path.

* * * * *